343-700 MS AU 254 EX
1/25/83 OR 4,370,657

United States Patent [19]
Kaloi

[11] 4,370,657
[45] Jan. 25, 1983

[54] ELECTRICALLY END COUPLED PARASITIC MICROSTRIP ANTENNAS

[75] Inventor: Cyril M. Kaloi, Thousand Oaks, Calif.

[73] Assignee: The United States of America as represented by the Secretary of the Navy, Washington, D.C.

[21] Appl. No.: 241,955

[22] Filed: Mar. 9, 1981

[51] Int. Cl.³ ..... H01Q 1/38
[52] U.S. Cl. ..... 343/700 MS; 343/729
[58] Field of Search ..... 343/700 MS, 729, 829, 343/830, 846

[56] References Cited

U.S. PATENT DOCUMENTS 3,214,760 10/1965 Yonkers ..... 343/753

*Primary Examiner*—Eli Lieberman
*Attorney, Agent, or Firm*—Robert F. Beers; Joseph M. St. Amand

[57] ABSTRACT

A microstrip antenna having a plurality of different radiating elements spaced apart in an end-to-end arrangement, above a ground plane and separated therefrom by a dielectric substrate; only one element is fed at its feedpoint, and energy emanating from the fed element is primarily coupled at one end to parasitic element(s) by the electric field generated in the fed element. The radiating pattern is determined by the phase relationship and amplitude distribution between the excited fed element and the parasitic element(s).

11 Claims, 14 Drawing Figures

ELECTRICALLY END COUPLED PARASITIC MICROSTRIP ANTENNAS

BACKGROUND OF THE INVENTION

This invention relates to microstrip antennas and more particularly to a plurality of radiating elements in an array wherein only one element is fed to excite the fed element directly and parasitically excite all the other elements for providing a high gain end fire antenna array.

Previously, it has been necessary to feed each of several microstrip elements with a separate coaxial connector to provide a high gain end fire antenna array. Phase shifters were also required in the separate coaxial lines feeding each of the separately fed elements. This required more space and expense, and complicated the conformal arraying capability of such an antenna especially where it was to be flush mounted on an airfoil surface. It also was necessary to use many more excited elements to provide as high a gain as obtained with the antenna in this invention.

U.S. Pat. No. 3,978,487, by Cyril M. Kaloi, discloses a side-by-side coupled fed microstrip antenna. That antenna differs greatly from the present electrically end-to-end coupled parasitic antenna disclosed herein, in that in the previous Coupled Fed Antenna two elements are coupled magnetically (i.e., magnetic field coupling) side-by-side; only one element is excited to radiate; the feedpoint is at the edge of the nonradiating coupler element; and, there is no end fire mode of radiation.

SUMMARY OF THE INVENTION

This microstrip parasitic fed antenna array has two or more radiating elements spaced apart in an end-to-end arrangement; only one element having a feedpoint. The two (or more) different microstrip radiating elements are positioned above a ground plane and separated therefrom by a dielectric substrate. The driven element is fed (e.g., (asymmetrically) at its feedpoint via a coaxial cable. Energy emanating from the coaxial fed element is primarily electrically coupled (i.e., electric field coupling) end-to-end to the parasitic element(s) by the electric field generated in the fed element (versus being primarily magnetically coupled in side-to-side elements as in U.S. Pat. No. 3,978,487 where only one element is excited to radiate). The radiating pattern is determined by the phase relationship and amplitude distribution between the excited fed element and the parasitic element(s). These functions are governed by the separation between the coaxial fed and parasitic elements and the length of the parasitic element(s). The antenna impedance (i.e., the mutual coupling impedance and the input impedance of the excited element) is also governed by the end-to-end separation between the elements and the length of the parasitic element(s). The phase relationship of the parasitic element(s) to the coaxial fed element is determined experimentally. One advantage is that fairly high gains are obtained in the end fire mode when the antenna is flush mounted. When a thick dielectric substrate is used with parasitic arrays, an additional advantage in end fire configuration is obtained. This advantage is due to the monopole mode excited in the coaxial fed element. A monopole mode will exist in all coaxial fed elements; however, the greater the spacing between the radiating element and ground plane the greater will be the effect of the monopole mode.

The end-to-end coupled parasitic microstrip antenna differs greatly from the aforementioned side-by-side magnetically coupled fed microstrip antenna disclosed in U.S. Pat. No. 3,978,487. In the parasitic microstrip antenna of this invention, the radiation pattern can be tilted in a preferred direction, and this cannot be done with the antenna in the aforementioned patent.

Also, coverage along the end fire direction is available from the present parasitic antennas, with gains of 8 db. or more being provided using two parasitic elements and only one element fed directly from a coaxial connector. Whereas, in other microstrip antennas where each microstrip element is fed from a separate coaxial connector, etc., on a fairly large ground plane, only gains as high as 6 db. have been available along the end fire direction using many more elements than accomplished with the present end-to-end coupled parasitic antenna.

DESCRIPTION AND OPERATION

Figure 1A:
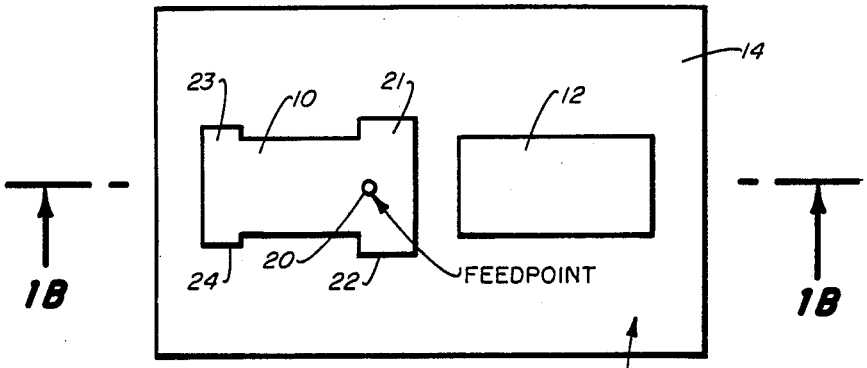
FIG. 1A is a top planar view of a typical two element parasitic microstrip antenna.
Figure 1B:
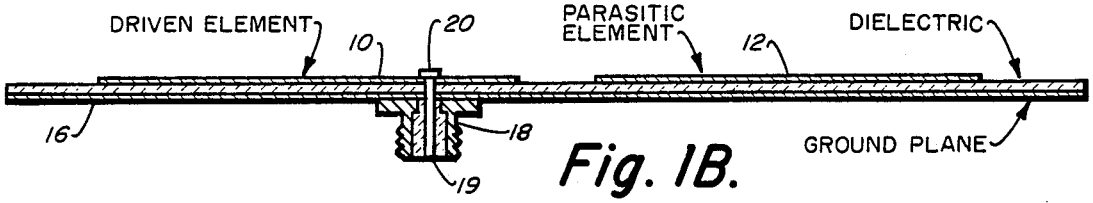
FIG. 1B is a cross-sectional view taken along section line 1B—1B of FIG. 1A.
Figure 1C:
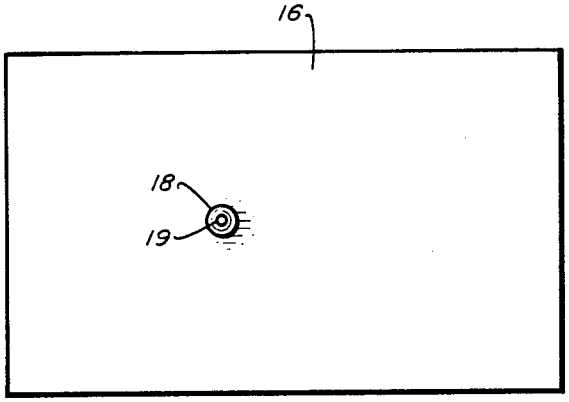
FIG. 1C shows a bottom planar view of the antenna shown in FIG. 1A.

FIGS. 1A, 1B and 1C show a typical electrically end coupled parasitic microstrip antenna of the present invention, having two radiating elements 10 and 12 formed on a dielectric substrate 14 which separates the radiating elements from ground plane 16. Radiating element 10 is fed from a coaxial-to-microstrip adapter 18 with the center pin 19 of the adapter extending to feedpoint 20 of element 10. Tabs 21 and 22 at one end, and tabs 23 and 24 at the other end of radiating element 10, are reactive loads which operate to effectively foreshorten the length of the radiating element as will hereinafter be discussed. Radiating element 12 is parasitically fed and excited with energy emanating from coaxial fed element 10 by end-to-end electric field coupling of the electric field generated in element 10 when that element is excited from energy fed thereto at coaxial adapter 18. The length of parasitic element 12 is usually somewhat less than the length of the coaxial fed element, and in antennas of this invention where more than one end-to-end coupled parasitic element is used the length of each successive parasitic element becomes progressively shorter.

Figure 1D:
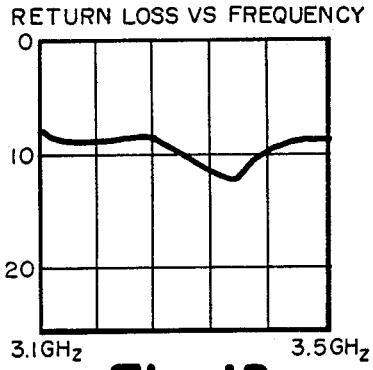
FIG. 1D is a plot showing the return loss versus frequency for a typical two element parasitic microstrip antenna, such as shown in FIG. 1A.
Figure 3:
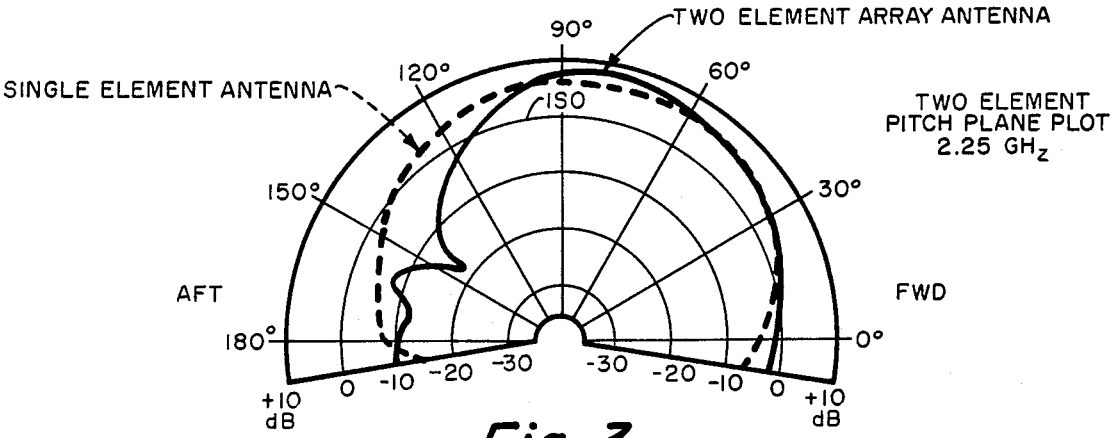
FIG. 3 shows antenna radiation patterns (Pitch plane) for both a single element microstrip antenna and a two element parasitic array, as in FIG. 1A, at a frequency of 2.25 GHz.

FIG. 1D shows a plot of return loss versus frequency from 3.1 to 3.5 GHz for a typical two element parasitic antenna, such as shown in FIGS. 1A, 1B and 1C.

Figure 2A:
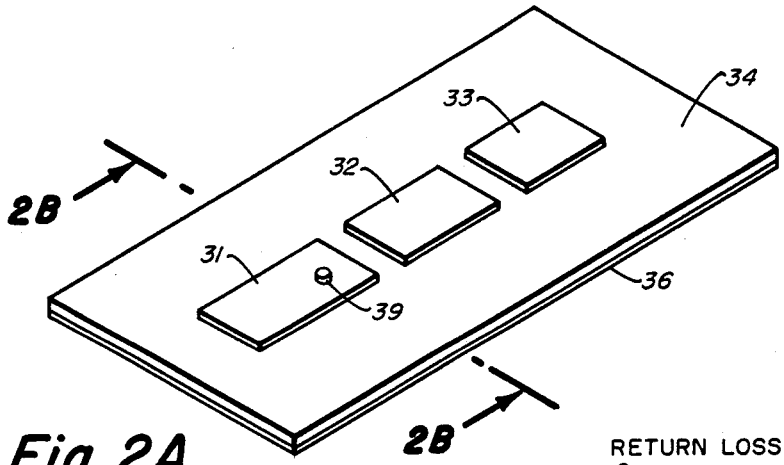
FIG. 2A is an isometric planar view of a typical three element parasitic microstrip antenna.
Figure 2B:
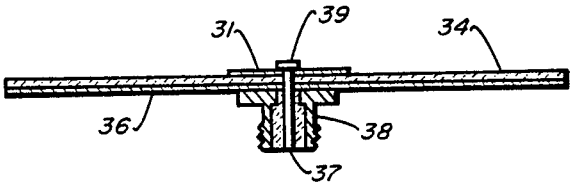
FIG. 2B is a cross-sectional view taken along line 2B—2B of FIG. 2A.

FIGS. 2A and 2B show a typical electrically end coupled parasitic microstrip antenna of this invention having three radiating elements 31, 32 and 33 formed on a dielectric substrate 34 which separates the radiating elements from ground plane 36. Radiating element 31 is coaxial fed with the center pin 37 of coaxial connector 38 connected to feedpoint 39. Radiating elements 32 and 33 are parasitically fed from energy emanating from coaxial fed element 31. The lengths of elements 31, 32 and 33 are progressively less; parasitic element 32 being shorter than element 31, and parasitic element 33 being shorter than element 32. No loading tabs are shown on this embodiment as foreshortening is not always required.

Figure 2C:
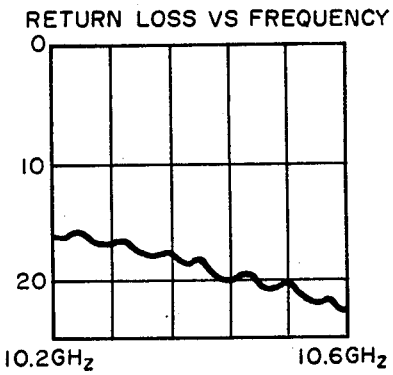
FIG. 2C is a plot showing return loss versus frequency for a typical three element parasitic microstrip antenna such as shown in FIG. 2A.
Figure 4:
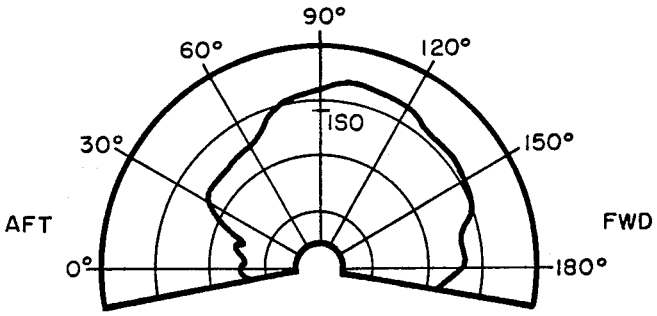
FIG. 4 shows an antenna radiation pattern (Pitch plane) for a typical two element parasitic array of the type shown in FIG. 1A at a frequency of 3.1 GHz.
Figure 5:
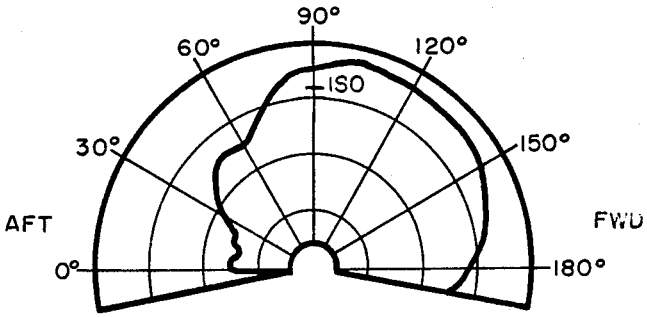
FIG. 5 shows an antenna radiation pattern (Pitch plane) for a typical two element parasitic array of the type shown in FIG. 1A at a frequency of 3.3 GHz.
Figure 6:
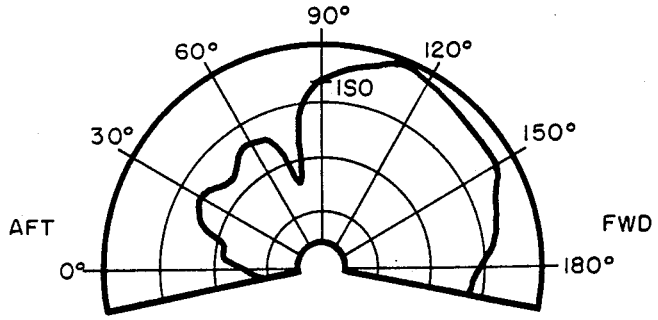
FIG. 6 shows an antenna radiation pattern (Pitch plane) for a typical two element parasitic array of the type shown in FIG. 1A at a frequency of 3.5 GHz.

FIG. 2C shows a plot of return loss versus frequency from 10.2 to 10.6 GHz for a typical three element parasitic antenna, such as shown in FIGS. 2A and 2B.

Figure 7:
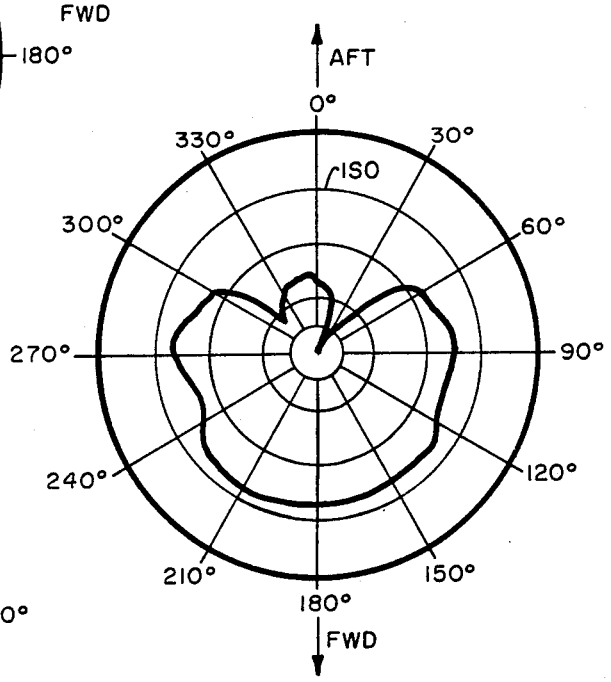
FIG. 7 shows an antenna radiation pattern (Yaw plane) for a typical two element parasitic array of the type shown in FIG. 1A at a frequency of 3.5 GHz.

FIGS. 3, 4, 5 and 6 show the radiation patterns bandwidth that can be expected from a typical two element antenna such as shown in FIGS. 1A, 1B and 1C. These plots also show good folding of the radiation patterns toward the end fire direction. FIG. 7 illustrates the Yaw radiation plot and shows good forward to aft ratio in the radiation patterns for a typical two element parasitic antenna.

Figure 8:
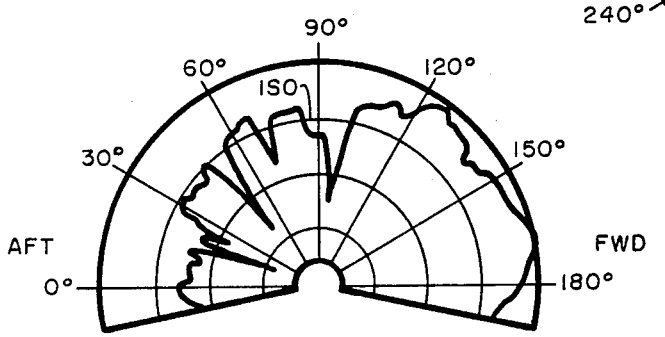
FIG. 8 shows an antenna radiation pattern (Pitch plane) for a typical three element parasitic array, such as shown in FIG. 2A, at a frequency of 10.2 GHz.
Figure 9:
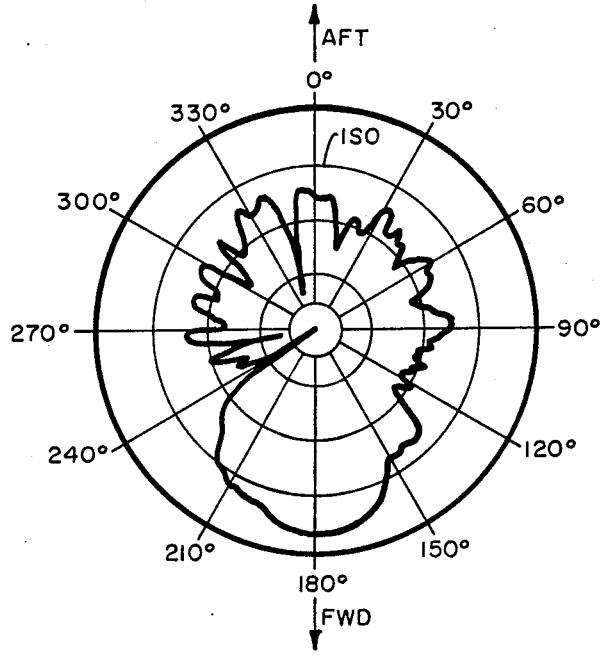
FIG. 9 shows an antenna radiation pattern (Yaw plane) for a typical three element parasitic array, such as shown in FIG. 2A, at a frequency of 10.2 GHz.

The radiation pattern in the plot of FIG. 8 shows a gain of approximately 8 db in the end fire direction for a typical three element parasitic antenna such as shown in FIGS. 2A and 2B. FIG. 9 shows the Yaw plane plot with a beam width of approximately 30° for a three element parasitic antenna as in FIGS. 2A and 2B.

Proper spacing between the coaxial fed element and the parasitic element(s) is necessary for impedance matching, and to provide proper phase between the coaxial fed and parasitic elements. Asymmetric feeding of the driven element (see U.S. Pat. No. 3,972,049) is used in the embodiments shown in FIGS. 1A and 2A in preference to other types of feeding (such as notch fed, corner fed, offset fed, etc.) since additional end fire gain is provided by using an asymmetrically fed microstrip element due to the surface wave launched as a result of the monopole effect of the coaxial connector pin in the cavity between the radiating element and the ground plane. This effect can be seen from the dotted line curve for a single element coaxial fed antenna in FIG. 3 which shows a tilting of the radiation pattern toward the forward direction.

It is known that for proper matching, the feedpoint for an asymmetrically fed element is normally at the 50 ohm point. In order to accomplish this and also to maintain the proper phase relationship in the parasitic antenna of the invention, the coaxial fed element may need to be longer which would result in physically overlapping the adjacent parasitic element. By including tuning tabs (i.e., reactive loads) on the coaxial fed element, the fed element can be effectively elongated while not being physically elongated, thereby maintaining a proper phase relationship and proper match. In other words, tuning tabs can be used to foreshorten the coaxially fed element to provide proper spacing between the parasitic and coaxial fed elements and maintain a proper match. However, in antennas where there is sufficient spacing between the ground plane and radiating element (i.e., thickness in the substrate the spacing inherently allows use of a shorter element at the same frequency and therefor foreshortening of the coaxial fed element by the use of tabs would not be necessary. The use of reactive load tuning tabs can also be used on parasitic elements, if necessary, whenever foreshortening of the parasitic elements is required. U.S. Pat. No. 4,151,531, col. 8, lines 11–33, also discusses the use of tabs for reactive loading of microstrip antenna elements. Although other types of microstrip fed elements, which do not require a coaxial feed, can be used in a parasitic array to provide gain in the end fire direction, the additional benefit of the monopole effect, due to the connector pin, is not provided. Other types of both electric and magnetic microstrip elements which are coaxially fed and can benefit from the monopole effect provided by the connector pin when used in parasitic microstrip antennas, are found in U.S. Pat. Nos. 3,984,834 and 4,095,227, for example.

The phase relationship and the amplitude relationship of the parasitic element(s) to the driven (coaxial fed) element is determined experimentally. This is accomplished by internal probing of the microstrip cavity, between each of the coaxial fed and parasitic radiating elements and the ground plane, to determine the phase and the amplitude of the coaxial fed and parasitic elements with relation to each other (i.e., provide relative amplitude and phase). In internal probing, a network analyzer, for example, along with a field probe, is used to determine the current distribution along the length of an element and the relative phase of the current at each measured point. At each measured point the current amplitude and its phase can be related to any other measured point on the same element or other element in the antenna array.

In designing an electrically end coupled parasitic microstrip antenna, a single element microstrip antenna is initially designed using design techniques for an asymmetrically fed microstrip antenna, for example, as disclosed in U.S. Pat. No. 3,972,049, and measurements made. The dotted line curve in FIG. 3, for example, is a single element radiation pattern for such a single element antenna. Next, an end fire array of two or more elements is analyzed, assuming an isotropic radiation pattern modified by the single element pattern of FIG. 3, using conventional design techniques. In the analysis for the end fire array it is assumed that all elements are excited in the same manner (e.g., coaxially fed). Conventional analysis techniques are used for determining the currents and phase required for each of the elements to provide end fire array design. This will give a first estimation of the required spacing between the elements of the parasitic antenna array.

Ideally, the energy in the end fire direction should add between the end coupled elements in an end fire array. For example, in a prior type two element array, where the radiating elements are spaced by one-half wavelength (½λ), the phase difference or delay between the two elements should be approximately 180°. To design a typical parasitic antenna as in FIG. 1A, a similar type of phasing is required. To accomplish this the inherent 90° phase difference between end-to-end coupled elements, which is well known in the microstrip coupler art, is used. Also, the phase relationship between the coaxial fed element and an end coupled parasitic element can be changed by changing the length of the parasitic element to provide additional phase difference or delay. Changing the length of the parasitic element changes the phase of the energy from the coaxial fed element that is induced into the parasitic element. By making the parasitic element shorter, it is made more capacitive, effectively incurring a greater degree of phase delay in the parasitic element. While 180° phase delay and ½λ spacing may be ideal, other phase delays and spacing can suffice assuming the signals maximally add in the end fire direction. Assuming that a 50° phase delay is provided by changing (i.e., shortening) the length of the parasitic element, a combination of the inherent 90° phase difference in end coupled elements along with the 50° phase delay due to the change in length of the parasitic element will provide a phase delay of 140°.

In the next step for producing the parasitic antenna in this example, the spacing between the coaxial fed and parasitic elements is changed to approximately 140° (i.e., 0.389λ). Then the radiating elements are probed again at the middle of each element and the overall phase relationship is determined.

However, moving the radiating elements closer together causes changes in the phase relationship (and impedance) due to mutual coupling, providing a mutual impedance in the parasitic element. It was found by experiment, that the mutual impedance adds more capacitance to the parasitic element thereby incurring more phase delay in the parasitic element. Thus it is required that the parasitic element be moved apart slightly more from the coaxial fed element. The new spacing of the radiating elements and new probe measurements of the elements for phase and amplitude are used in new analysis calculations to provide values for further iteration in producing the parasitic antenna array. Several changes in spacing and probing of the radiating elements are usually required to provide an optimum parasitic antenna design.

The experimental process is essentially the same when more than one parasitic element is used, such as between coaxial fed element 31 and parasitically excited element 32, and between parasitic elements 32 and 33 in the antenna shown in FIGS. 2A and 2B, for example, and in other parasitic antenna arrays.

Obviously, many modifications and variations of the present invention are possible in the light of the above teachings. It is therefore to be understood that within the scope of the appended claims the invention may be practiced otherwise than as specifically described.

What is claimed is:

1. An electrically end coupled parasitic microstrip antenna for providing high gain in the end fire mode, comprising:

a. a thin ground plane conductor;

b. a driven microstrip radiating element having a feedpoint thereon;

c. said driven radiating element being fed from a microwave transmission line at said feedpoint;

d. at least one parasitic microstrip radiating element being spaced apart from one end of said driven radiating element in an end-to-end arrangement;

e. said driven microstrip radiating element and said at least one parasitic microstrip radiating element being equally spaced apart from said ground plane and separated from said ground plane by a dielectric substrate;

f. said driven microstrip radiating element being electrically coupled end-to-end to said at least one parasitic microstrip radiating element by the electric field generated in said driven element when excited to radiate by energy fed to said feedpoint; both said driven element and said at least one parasitic element being excited to radiate, the energy in the end fire direction adding between the end-to-end coupled microstrip elements to provide high gain;

g. the antenna radiation pattern being determined by the phase relationship and amplitude distribution between said excited driven element and said at least one parasitic element, the phase relationship and amplitude distribution being governed by the end-to-end separation between the driven element and said at least one parasitic element and the length of said at least one parasitic element; the mutual coupling impedance and the input impedance of the driven element which together form the antenna impedance also being governed by the end-to-end separation between the driven element and said at least one parasitic element.

2. An electrically end coupled parasitic microstrip antenna as in claim 1 wherein said driven microstrip radiating element is fed from a coaxial-to-microstrip adapter at said feedpoint.

3. An electrically end coupled parasitic microstrip antenna as in claim 2 wherein additional gain in the end fire direction is provided by the monopole mode excited in the antenna cavity beneath the coaxial fed driven element due to the connector pin of said coaxial-to-microstrip adapter; said excited monopole mode increasing with the spacing (i.e., cavity) between the driven element and the ground plane.

4. An electrically end coupled parasitic microstrip antenna as in claim 1 wherein the length of said parasitic microstrip radiating element is less than the length of said driven element.

5. An electrically end coupled parasitic microstrip antenna as in claim 1 wherein a plurality of end-to-end electrically coupled parasitic elements are coupled in succession to one end of said driven element.

6. An electrically end coupled parasitic microstrip antenna as in claim 5 wherein the length of each successive parasitic element becomes progressively shorter as the distance away from the driven element increases.

7. An electrically end coupled parasitic microstrip antenna as in claim 1 wherein reactive load tabs are provided at either end of any of said microstrip radiating elements to foreshorten said radiating elements for providing proper spacing and proper match between radiating elements.

8. An electrically end coupled parasitic microstrip antenna as in claim 1 wherein said driven element is asymmetrically fed.

9. An electrically end coupled parasitic microstrip antenna as in claim 1 wherein the inherent 90° phase difference between end-to-end electrically coupled microstrip radiating elements is combined with additional phase difference made by making the length of said at least one parasitic element shorter and thus more capacitive to incur a greater degree of phase delay in the parasitic element, thereby increasing the antenna gain in the end fire direction.

10. An electrically end coupled parasitic microstrip antenna as in claim 1 wherein two parasitic elements are electrically coupled end-to-end with said driven element to provide a gain in the end fire direction of approximately 8 db.

11. An electrically end coupled parasitic microstrip antenna as in claim 1 wherein the antenna radiation pattern is tilted in a preferred direction.

* * * * *